US010161687B2

(12) United States Patent
Uchino

(10) Patent No.: US 10,161,687 B2
(45) Date of Patent: Dec. 25, 2018

(54) PLATE HEAT EXCHANGER AND HEAT PUMP OUTDOOR UNIT

(71) Applicant: Mitsubishi Electric Corporation, Tokyo (JP)

(72) Inventor: Shinichi Uchino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/521,648

(22) PCT Filed: Jan. 22, 2015

(86) PCT No.: PCT/JP2015/051630

§ 371 (c)(1),
(2) Date: Apr. 25, 2017

(87) PCT Pub. No.: WO2016/117069

PCT Pub. Date: Jul. 28, 2016

(65) Prior Publication Data

US 2017/0248373 A1 Aug. 31, 2017

(51) Int. Cl.
*F28D 9/00* (2006.01)
*F24D 3/08* (2006.01)
(Continued)

(52) U.S. Cl.
CPC ..... *F28D 9/0093* (2013.01); *F24D 3/08* (2013.01); *F24D 11/0214* (2013.01);
(Continued)

(58) Field of Classification Search
CPC .... F28F 3/046; F28F 2225/00; F28F 2270/00; F24D 3/08; F24D 11/0214; F24D 17/02;
(Continued)

(56) References Cited

U.S. PATENT DOCUMENTS

2001/0018969 A1* 9/2001 Shin ..... F28D 1/0341 165/153
2005/0155749 A1* 7/2005 Memory ..... F28D 9/005 165/167
(Continued)

FOREIGN PATENT DOCUMENTS

CN 103162473 A 6/2013
JP 2005-106385 A 4/2005
(Continued)

OTHER PUBLICATIONS

Extended European Search Report dated Apr. 19, 2017 in the corresponding EP Patent Application No. 15866368.2.
(Continued)

*Primary Examiner* — Cassey D Bauer
(74) *Attorney, Agent, or Firm* — Posz Law Group, PLC

(57) ABSTRACT

A plate heat exchanger can reduce thermal contact between a second fluid (water and a third fluid (low-temperature, low-pressure two-phase refrigerant) to enhance thermal efficiency. A plate heat exchanger includes a heat transfer plate group that performs heat exchange between a first fluid of high-temperature, high-pressure gas refrigerant and a second fluid of a heating target fluid; and a heat transfer plate group that performs heat exchange between a first fluid of low-temperature, high-pressure liquid refrigerant and a third fluid of low-temperature, low-pressure two-phase liquid refrigerant. The heat transfer plate group forms refrigerant channels including a stack of plates, has a configuration that a flow of the first fluid of high-temperature, high-pressure gas refrigerant and a flow of the second fluid are alternately aligned in the refrigerant channels, and causes the second fluid to flow in the outermost refrigerant channel.

5 Claims, 15 Drawing Sheets

(51) Int. Cl.

| | |
|---|---|
| ***F24D 11/02*** | (2006.01) |
| ***F24D 17/02*** | (2006.01) |
| ***F25B 39/04*** | (2006.01) |
| ***F28F 3/04*** | (2006.01) |
| ***F25B 30/02*** | (2006.01) |
| ***F25B 39/00*** | (2006.01) |

(52) U.S. Cl.

CPC ..... *F24D 17/02* (2013.01); *F25B 30/02* (2013.01); *F25B 39/00* (2013.01); *F25B 39/04* (2013.01); *F28D 9/005* (2013.01); *F28F 3/046* (2013.01); *F24D 2200/123* (2013.01); *F25B 2339/043* (2013.01); *F25B 2339/047* (2013.01); *F25B 2400/13* (2013.01); *F28D 9/00* (2013.01); *F28F 2225/00* (2013.01); *F28F 2270/00* (2013.01); *Y02B 30/126* (2013.01)

(58) Field of Classification Search

CPC .. F24D 2200/123; F28D 9/005; F28D 9/0093; Y02B 30/126; F25B 39/04; F25B 30/02; F25B 39/00; F25B 2339/043; F25B 2339/047; F25B 2400/13

USPC ..... 165/104.21; 62/324.1

See application file for complete search history.

(56) References Cited

U.S. PATENT DOCUMENTS

| | | | | |
|---|---|---|---|---|
| 2010/0258095 | A1* | 10/2010 | Saumweber | F28D 9/005 123/542 |
| 2010/0294466 | A1* | 11/2010 | Shimaoka | F24F 1/24 165/104.33 |
| 2013/0146257 | A1 | 6/2013 | Kim et al. | |
| 2014/0008047 | A1* | 1/2014 | Ito | F28F 3/046 165/166 |
| 2014/0182322 | A1* | 7/2014 | Ito | F28F 3/046 62/324.1 |

FOREIGN PATENT DOCUMENTS

| | | | |
|---|---|---|---|
| JP | 2007-178029 | A | 7/2007 |
| JP | 2011-052884 | A | 3/2011 |

OTHER PUBLICATIONS

International Search Report of the International Searching Authority dated Apr. 28, 2015 for the corresponding International application No. PCT/JP2015/051630 (and English translation).

Communication pursuant to Article 94(3) EPC dated Nov. 22, 2017 in the corresponding EP Patent Application No. 15866368.2.

Office Action dated Oct. 24, 2018 in the corresponding Chinese Patent Application No. 201580074080.8 (and English translation).

* cited by examiner (1/N) N=2

(2/N) N=2

PLATE HEAT EXCHANGER AND HEAT PUMP OUTDOOR UNIT

CROSS REFERENCE TO RELATED APPLICATION

This application is a U.S. national stage application of PCT/JP2015/051630 filed on Jan. 22, 2015, the contents of which are incorporated herein by reference.

TECHNICAL FIELD

The present invention relates to a plate heat exchanger that performs heat exchange between refrigerant and heating target fluid, and a heat pump outdoor unit including the same.

BACKGROUND ART

A heat pump outdoor unit for performing hot-water supply or a cooling/heating operation includes a system using a plate heat exchanger as a condenser and a subcooler. Examples of the plate heat exchanger include a plate heat exchanger serving as both a condenser and a subcooler. For example, in a proposed plate heat exchanger, a boundary plate is provided in a heat transfer unit to define two heat exchange units (a condensation unit and a subcooling unit) (see, for example, Patent Literature 1).

CITATION LIST

Patent Literature

Patent Literature 1: Japanese Unexamined Patent Application Publication No. 2005-106385

SUMMARY OF INVENTION

Technical Problem

In the plate heat exchanger proposed in Patent Literature 1, a first fluid (high-temperature, high-pressure gas refrigerant) that is a heating fluid and a second fluid (water) that is a heating target fluid, both being to exchange heat with each other, flow in the first heat exchange unit (condensation unit). A first fluid (low-temperature, high-pressure liquid refrigerant) that is a heating fluid and a third fluid (low-temperature, low-pressure two-phase refrigerant) that is a heating target fluid, both being to exchange heat with each other, flow in the second heat exchange unit (subcooling unit). In a case where the first heat exchange unit (condensation unit) and the second heat exchange unit (subcooling unit) are included in the same plate heat exchanger, the second fluid (water) and the third fluid (low-temperature, low-pressure two-phase refrigerant) exchange heat with each other through the boundary plate in a portion of the plate heat exchanger so that the temperature of the second fluid (water) decreases and, thereby, thermal efficiency decreases.

The present invention has been made to solve the problems described above, and provides a plate heat exchanger that can suppress thermal contact between the second fluid (water) and the third fluid (low-temperature, low-pressure two-phase refrigerant) and enhance thermal efficiency.

Solution to Problem

The present invention provides a plate heat exchanger including: a first heat transfer plate group that performs heat exchange between a first fluid of high-temperature, high-pressure gas refrigerant and a second fluid of a heating target fluid; and a second heat transfer plate group that performs heat exchange between a first fluid of low-temperature, high-pressure liquid refrigerant and a third fluid of low-temperature, low-pressure two-phase liquid refrigerant, wherein the first heat transfer plate group forms a plurality of refrigerant channels constituted by a stack of plates, has a configuration that a flow of the first fluid of high-temperature, high-pressure gas refrigerant and a flow of the second fluid are alternately aligned in the refrigerant channels, and causes the second fluid to flow in an outermost one of the refrigerant channels, and the second heat transfer plate group forms a plurality of refrigerant channels constituted by a stack of plates, has a configuration that a flow of the first fluid of low-temperature, high-pressure liquid refrigerant and a flow of the third fluid are alternately aligned in the refrigerant channels, and causes the first fluid of low-temperature, high-pressure liquid refrigerant to flow in one of the refrigerant channels adjacent to the first heat transfer plate group.

Advantageous Effects of Invention

According to the present invention, a flow of the first refrigerant and a flow of the second refrigerant are alternately aligned in the refrigerant channels of the first heat transfer plate group, and the second fluid flows in the outermost refrigerant channel. In the refrigerant channels of the second heat transfer plate group, a flow of the first refrigerant and a flow of the second refrigerant are also alternately aligned, and the first fluid of low-temperature, high-pressure liquid refrigerant flows in the refrigerant channel adjacent to the first heat transfer plate group. Thus, the first fluid of low-temperature, high-pressure liquid refrigerant flows between the second fluid and the third fluid. Thus, thermal contact between the second fluid and the third fluid can be suppressed, and a temperature difference between the fluids decreases so that the amount of heat transfer from the second fluid can be reduced, and thermal efficiency can be enhanced.

DESCRIPTION OF EMBODIMENTS

Embodiment 1

Figure 1:
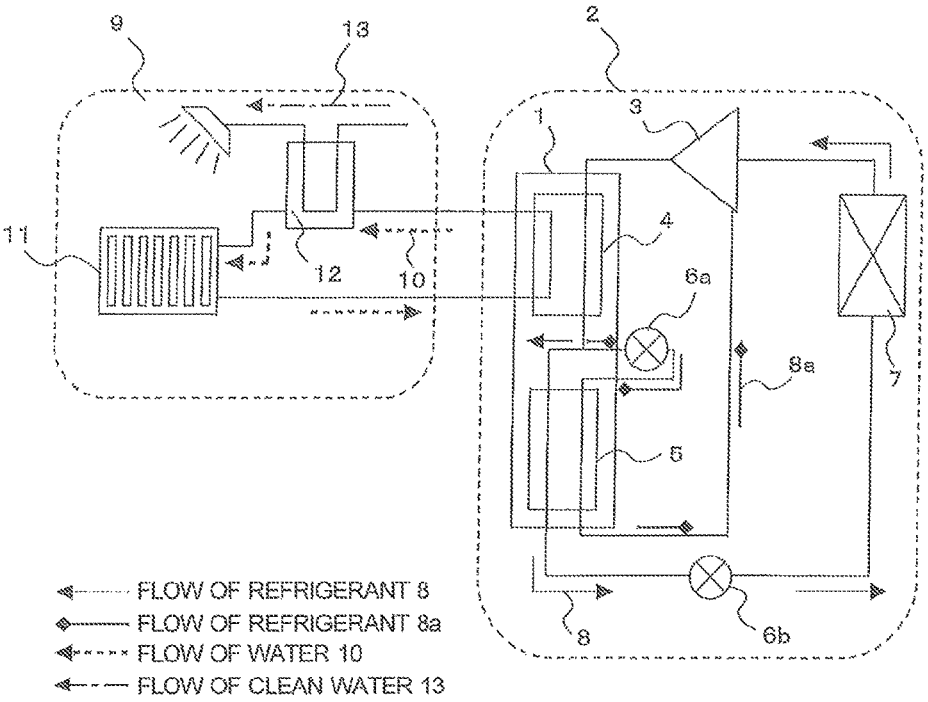
FIG. 1 is a refrigerant circuit diagram of a heat pump hot-water supply apparatus according to Embodiment 1 of the present invention.

FIG. 1 is a refrigerant circuit diagram of a heat pump hot-water supply apparatus according to Embodiment 1 of the present invention. The heat pump hot-water supply apparatus illustrated in FIG. 1 includes a heat pump outdoor unit (heat pump unit) 2 and a water circuit 9, The heat pump outdoor unit 2 includes a compressor 3, a first heat exchanger 4, a second heat exchanger 5, electronic expansion valves 6*a* and 6*b*, and a third heat exchanger 7. Operations of these components will be described below.

(1) The compressor 3 compresses refrigerant 8 by using electric power and increases an enthalpy and a pressure of the refrigerant 8.

(2) The first heat exchanger 4 performs heat exchange between the compressed refrigerant 8 (first fluid) and a heating target fluid (second fluid).

(3) The electronic expansion valve 6*a* adiabatically expands a part (refrigerant 8*a*) of the refrigerant 8 from the first heat exchanger 4. The electronic expansion valve 6*a* corresponds to a first expansion valve of the present invention.

(4) The second heat exchanger 5 performs heat exchange between the refrigerant 8 (first fluid) from first heat exchanger 4 and the refrigerant 8*a* (third fluid) that is a part of the refrigerant 8 and subjected to pressure reduction through the electronic expansion valve 6*a*. The third fluid is gasified through the heat exchange and is sucked into the compressor 3.

(5) The electronic expansion valve 6*b* adiabatically expands the refrigerant 8 from the second heat exchanger 5. The electronic expansion valve 6*b* corresponds to a second expansion valve of the present invention.

(6) The third heat exchanger 7 performs heat exchange between the refrigerant 8 from the electronic expansion valve 6*b* and an external heat source. Although not shown, the heat pump outdoor unit 2 may include other attachments such as a receiver for storing excess refrigerant 8.

The compressor 3 to the third heat exchanger 7 described above constitute a refrigeration cycle mechanism in which the first fluid circulates. A plate heat exchanger 1 is used as the first heat exchanger 4. In this manner, heat (heat absorbed in the third heat exchanger 7) of an external heat source is transferred by the plate heat exchanger 1 so that the second fluid flowed into the plate heat exchanger 1 is heated. Examples of a medium used as the external heat source (a target of heat exchange in the third heat exchanger 7) include various media such as air and geothermal heat. The plate heat exchanger 1 can be used for any type of the heat pump outdoor unit 2 using an external heat source. In Embodiment 1, the plate heat exchanger 1 includes the second heat exchanger 5 in addition to the first heat exchanger 4, that is, includes two heat exchangers.

The heat pump outdoor unit 2 uses, for example, water 10 as the second fluid. The water 10 circulates in the water circuit 9. The example illustrated in FIG. 1 employs an indirect heating technique. The water 10 flows into the plate heat exchanger 1, which is the first heat exchanger 4, is heated by the first fluid (refrigerant 8), and flows out of the plate heat exchanger 1. After having flowed from the plate heat exchanger 1, the water 10 flows into a heating appliance 11, such as a radiator or a floor heating, connected by pipes constituting the water circuit 9 to be used for indoor temperature control. The water circuit 9 includes a water-to-water heat exchange tank 12 for heat exchange between the water 10 and clean water 13 so that the clean water 13 heated by the water 10 can be used as water for domestic use, such as bathing or shower.

A configuration of the plate heat exchanger 1 illustrated in FIG. 1 will now be described.

Figure 2A:
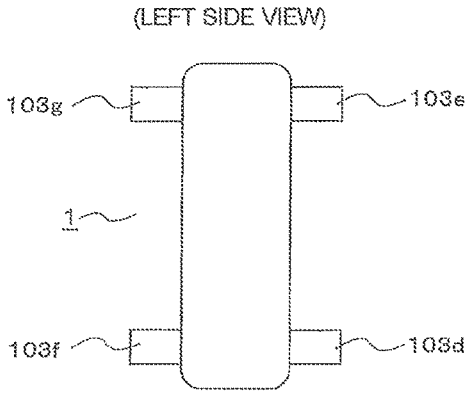
FIG. 2*a* is a left side view of the plate heat exchanger illustrated in FIG. 1.
Figure 2B:
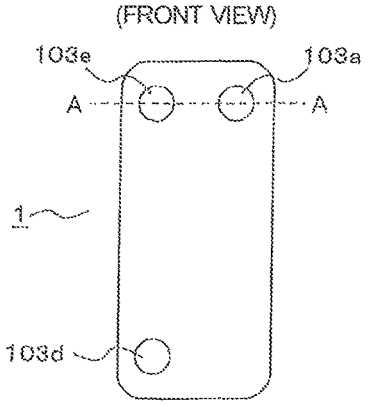
FIG. 2*b* is a front view of the plate heat exchanger illustrated in FIG. 1.
Figure 2C:
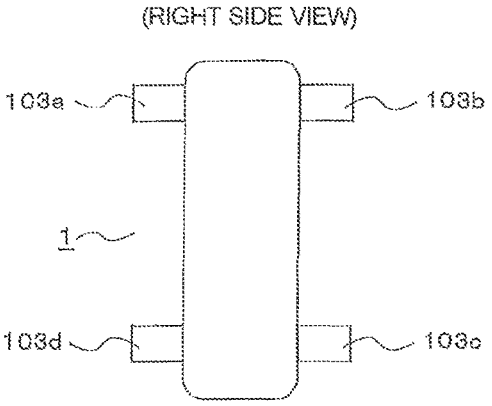
FIG. 2*c* is a right side view of the plate heat exchanger illustrated in FIG. 1.
Figure 2D:
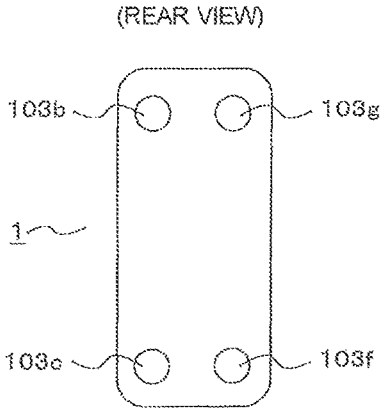
FIG. 2*d* is a rear view of the plate heat exchanger illustrated in FIG. 1.

FIG. 2*a* is a left side view of the plate heat exchanger illustrated in FIG. 1, FIG. 2*b* is a front view of the plate heat exchanger illustrated in FIG. 1, FIG. 2*c* is a right side view of the plate heat exchanger illustrated in FIG. 1, and FIG. 2*d* is a rear view of the plate heat exchanger illustrated in FIG. 1.

As illustrated in FIGS. 2*a* to 2*d*, the plate heat exchanger 1 includes nozzles 103*a* to 103*g*. As illustrated in FIG. 2*b*, the three nozzles 103*a*, 103*d*, and 103*e* are attached to the front face of the plate heat exchanger 1. As illustrated in FIG. 2*d*, the four nozzles 103*b*, 103*c*, 103*fe*, and 130*g* are attached to the rear face of the plate heat exchanger 1. The first fluid flowed through the nozzle 103*a*, which is a first fluid inlet, flows out from two outlets, that is, the nozzle 103*b* that is a first outlet and the nozzle 103*c* that is a second outlet. A passage in which the first refrigerant flows is a first channel. As will be described in detail later, the first fluid flows out of the nozzle 103*b* after having exchanged heat with the second fluid and the third fluid. The first fluid flows out of the nozzle 103*c* after having exchanged heat with the second fluid (not having exchanged heat with the third fluid). The second fluid flowed through the nozzle 103*d* that is a second fluid inlet, flows out of the nozzle 103*e* that is a second fluid outlet. A passage in which the second fluid flows is a second channel. The third fluid flowed through the nozzle 103*f* that is a third fluid inlet, flows out of the nozzle 103*g* that is a third fluid outlet. A passage in which the third fluid flows is a third channel. The first channel, the second channel, and the third channel constitute channels that are independent of each other.

Figure 3:
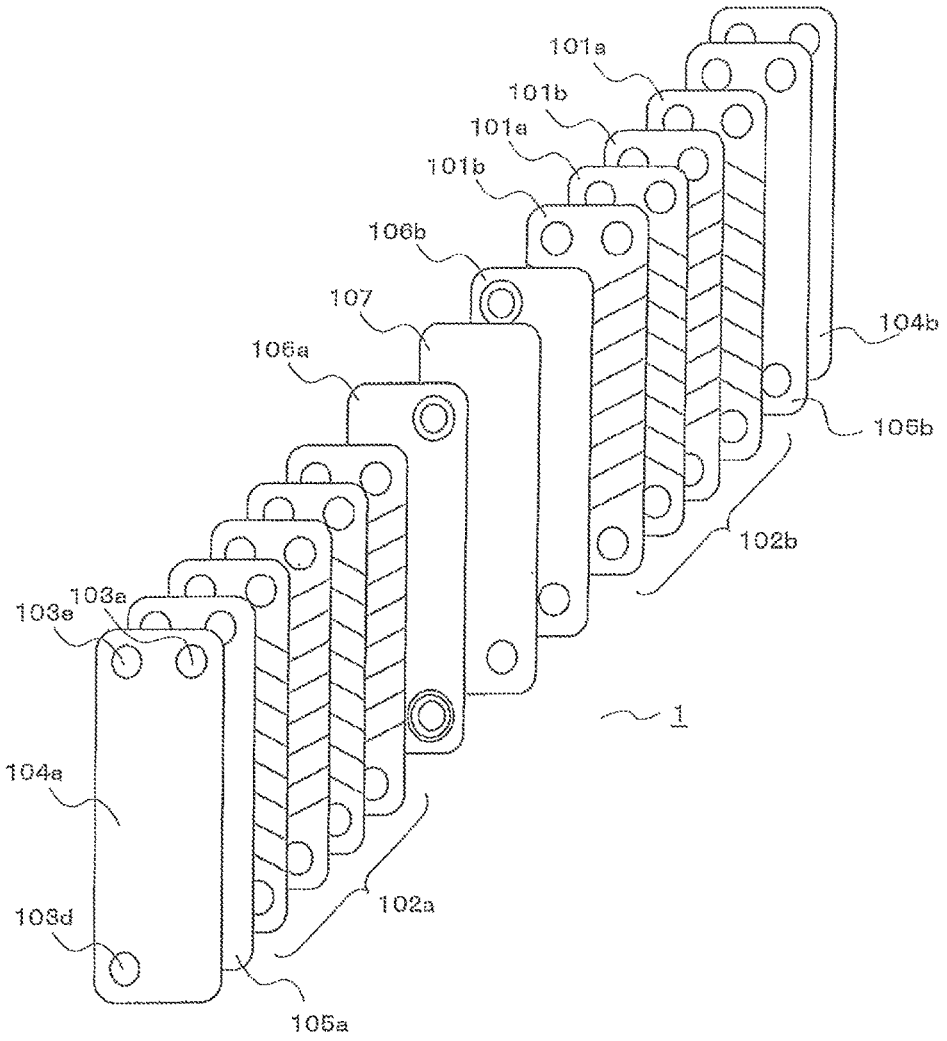
FIG. 3 is a disassembled perspective view of the plate heat exchanger illustrated in FIG. 1.

FIG. 3 is a disassembled perspective view of the plate heat exchanger illustrated in FIG. 1. As illustrated in FIG. 3, in the plate heat exchanger 1, a reinforcing plate 104*a* to which the nozzles 103*a*, 103*d*, and 103*e* are attached, a side plate 105*a*, a heat transfer plate group 102*a* (a heat transfer plate 101*a*, a heat transfer plate 101*b*, . . . , a heat transfer plate 101*a*, and a heat transfer plate 101*b*) corresponding to the first heat exchanger 4, an isolation plate 106*a*, an intermediate reinforcing plate 107, an isolation plate 106*b*, a heat transfer plate group 102*b* (a heat transfer plate 101*a*, a heat transfer plate 101*b* . . . , a heat transfer plate 101*a*, and a heat transfer plate 101*b*) corresponding to the second heat exchanger 5, a side plate 105*b*, a reinforcing plate 104*b* to which the nozzles 103*b*, 103*c*, 103*f*, and 103*g* are attached, are stacked in this order.

Then, flows of the first to third fluids in the plate heat exchanger 1 will be described.

Figure 4:
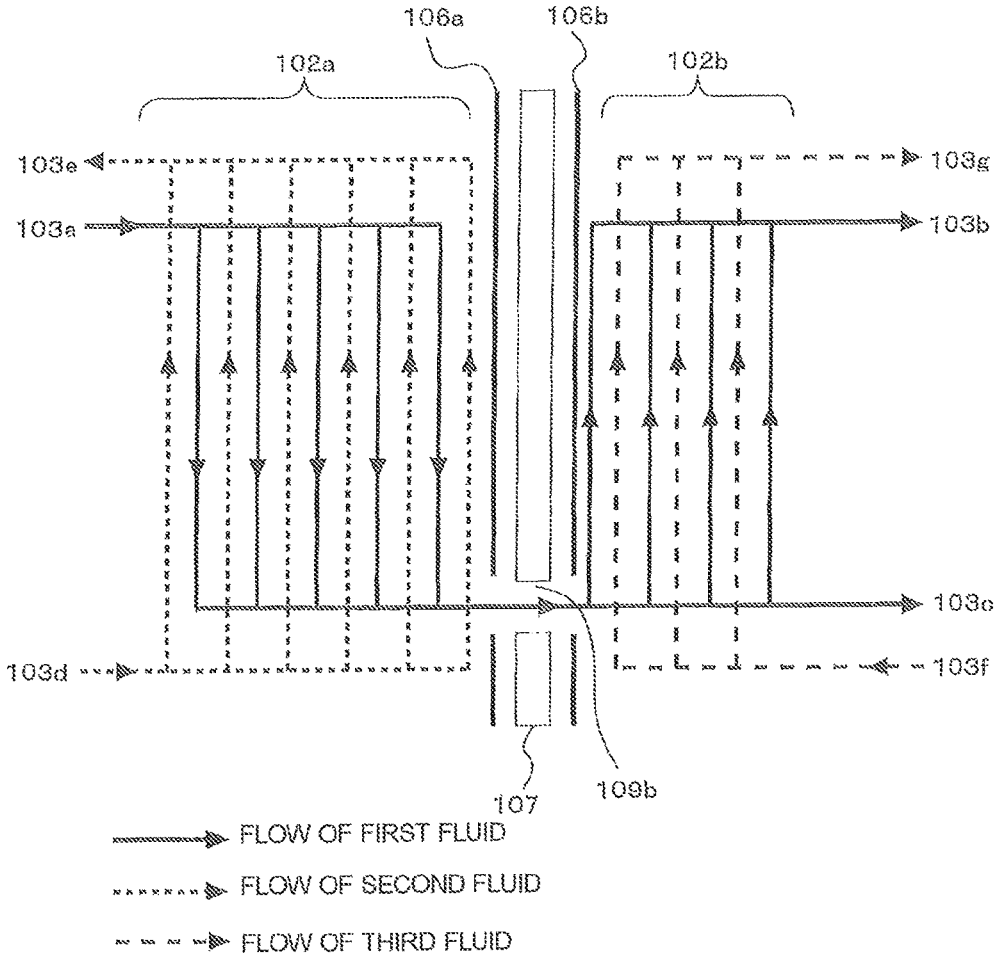
FIG. 4 schematically illustrates a flow of fluid in the plate heat exchanger illustrated in FIG. 1.

FIG. 4 schematically illustrates a flow of the fluids in the plate heat exchanger 1 illustrated in FIG. 1.

The first fluid (refrigerant 8) flows from the nozzle 103*a* into the heat transfer plate group 102*a*, passes through channel holes formed in the isolation plate 106*a*, the intermediate reinforcing plate 107, and the isolation plate 106*b*, and flows into the heat transfer plate group 102*b*. The first fluid flowed into the heat transfer plate group 102*b* is divided into a first fluid that exchanges heat with the third fluid (refrigerant 8*a*) and flows out of the nozzle 103*b* and a first fluid (which is to be a third fluid subjected to an expansion process) that does not exchange heat with the third fluid (refrigerant 8*a*) and flows out of the nozzle 103*c*. The second fluid (heating target fluid) flows into the heat transfer plate group 102*a* from the nozzle 103*d*, and flows out of the nozzle 103*e*. The third fluid flows into the heat transfer plate group 102*b* from the nozzle 103*f*, and flows out of the nozzle 103*g*.

The heat transfer plate group 102*a* corresponds to a first heat transfer plate group of the present invention. The heat transfer plate group 102*b* corresponds to a second heat transfer plate group of the present invention. The refrigerant flowed from the nozzle 103*a* corresponds to a first fluid of high-temperature, high-pressure gas refrigerant of the present invention. The second fluid (heating target fluid) flowed from the nozzle 103*d* corresponds to a second fluid of a heating target fluid of the present invention. The third fluid flowed from the nozzle 103*f* corresponds to a low-temperature, low-pressure third fluid of the present invention. The first fluid that has exchanged heat in the heat transfer plate group 102*a* and flowed into the heat transfer plate group 102*b* corresponds to a low-temperature, high-pressure first fluid of the present invention.

Referring now to FIGS. 5 to 11, a configuration of the plate heat exchanger 1 will be specifically described.

Figure 5:
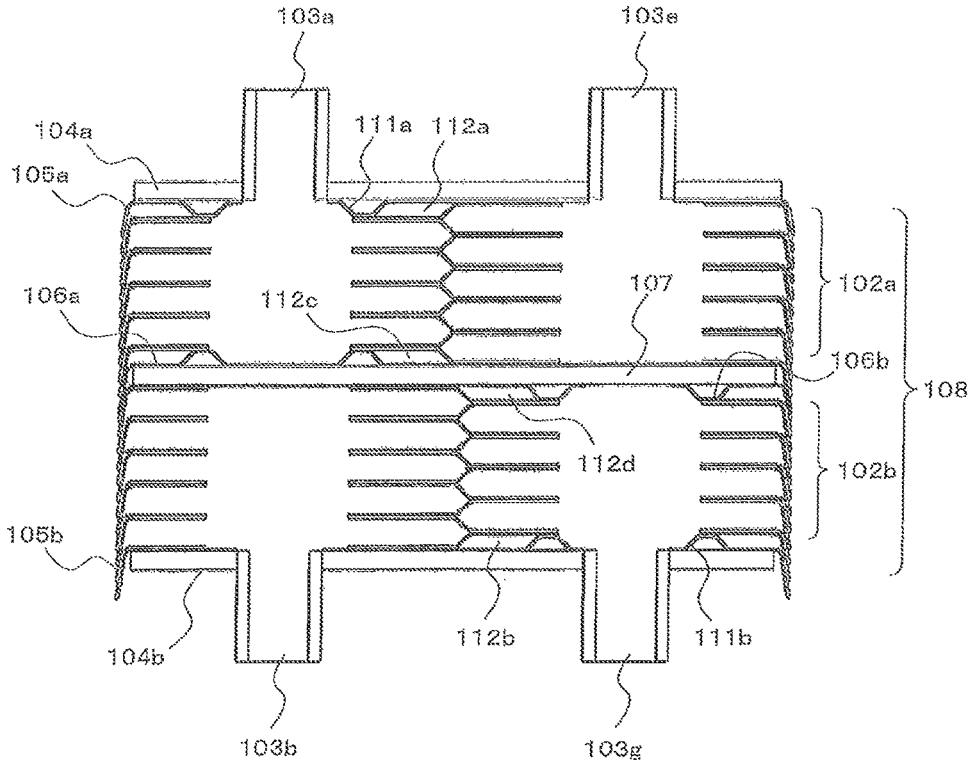
FIG. 5 is a cross-sectional view taken along line A-A in FIG. 2*b*.
Figure 6:
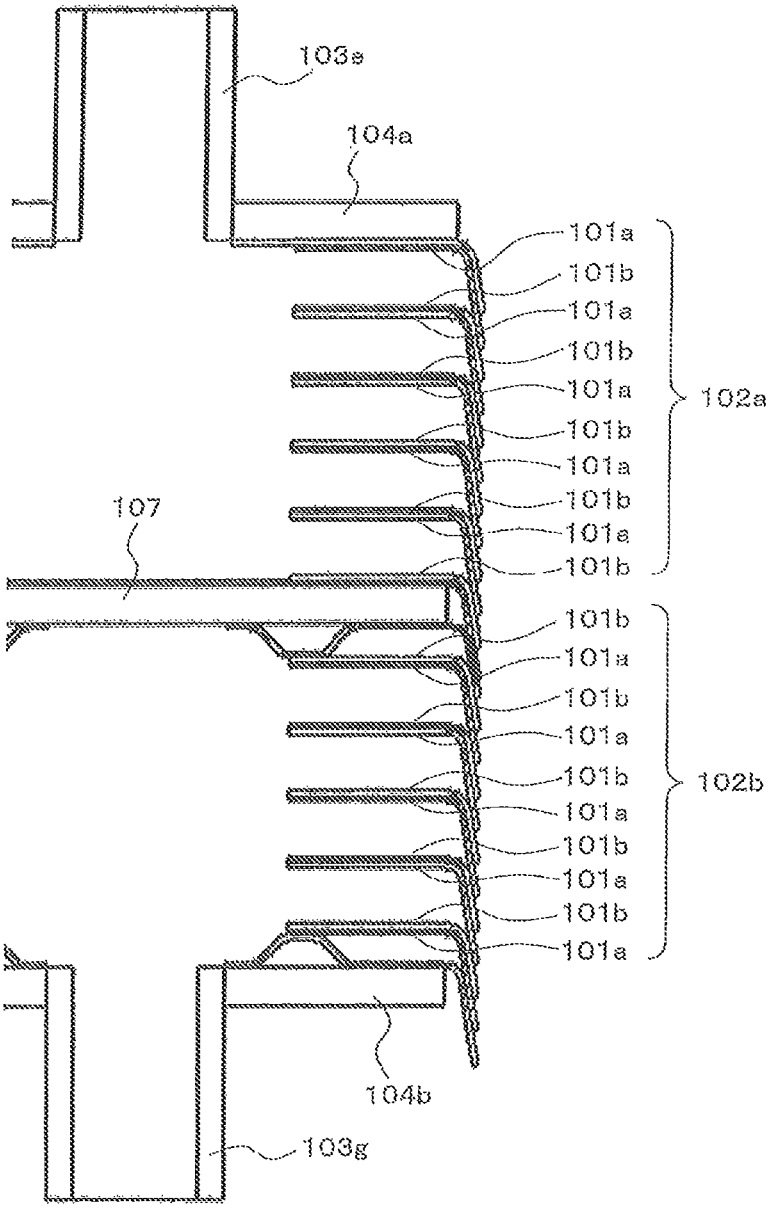
FIG. 6 is a partially enlarged view of a heat transfer plate group (102*a*, 102*b*) illustrated in FIG. 5.

FIG. 5 is a cross-sectional view corresponding to an A-A section in FIG. 2. Regarding to FIG. 5, the term "corresponding to" is used for the following reason. For simplicity of description in FIG. 5, a total of ten heat transfer plates 101*a* and 101*b* constituting the heat transfer plate groups 102*a* and 102*b* are used. Thus, since FIG. 5 is not identical to FIG. 2, the term "corresponding to" is used. FIG. 6 is a partially enlarged view of the heat transfer plate groups 102*a* and 102*b* illustrated in FIG. 5. The top and bottom in description with reference to FIG. 5 or FIG. 6 respectively refer to the top and bottom in the illustrated positional relationship.

As illustrated in FIGS. 5 and 6, as a main configuration of the plate heat exchanger 1 according to Embodiment 1, the heat transfer plates 101*a* and 101*b* are stacked so that the heat transfer plate groups 102*a* and 102*b* form channels for heat exchange between the first fluid and the second fluid and between the first fluid and the third fluid. The isolation plate 106*a*, the intermediate reinforcing plate 107, and the isolation plate 106*b* are disposed between the heat transfer plate groups 102*a* and 102*b*. A fundamental part 108 of the plate heat exchanger 1 (hereinafter referred to as a fundamental part 108) is constituted by disposing the side plate 105*a* on top of the heat transfer plate group 102*a* and the side plate 105*b* at the bottom of the heat transfer plate group 102*b*. The reinforcing plate 104*a* is disposed on top of the fundamental part 108 and the reinforcing plate 104*b* is disposed at the bottom of the fundamental part 108 so that the fundamental part 108 is sandwiched between the reinforcing plate 104*a* and the reinforcing plate 104*b*. The reinforcing plates 104*a* and 104*b* have nozzle attachment ports (nozzle holes). The nozzles 103*a*, 103*d*, and 103*e* are attached to the nozzle attachment ports of the reinforcing plate 104*a*. The nozzles 103*b*, 130*c*, 103*f*, and 103*g* are attached to the nozzle attachment ports of the reinforcing plate 104*b*. In FIG. 5, the nozzles 103*c*, 103*d*, and 103*f* are behind the nozzles 103*b*, 103*e*, and 103*g*, and thus, are not shown.

(Heat Transfer Plate 101*a* and Heat Transfer Plate 101*b*)

Figure 7A:
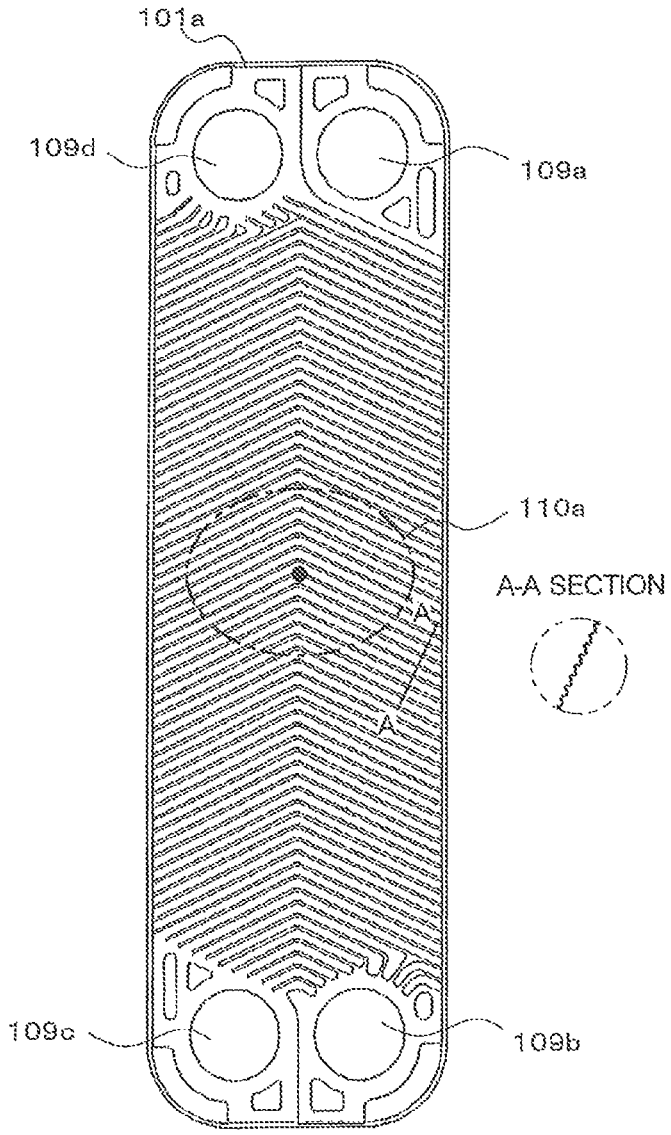
FIG. 7*a* is a full view of a heat transfer plate (101*a*) illustrated in FIG. 6.
Figure 7B:
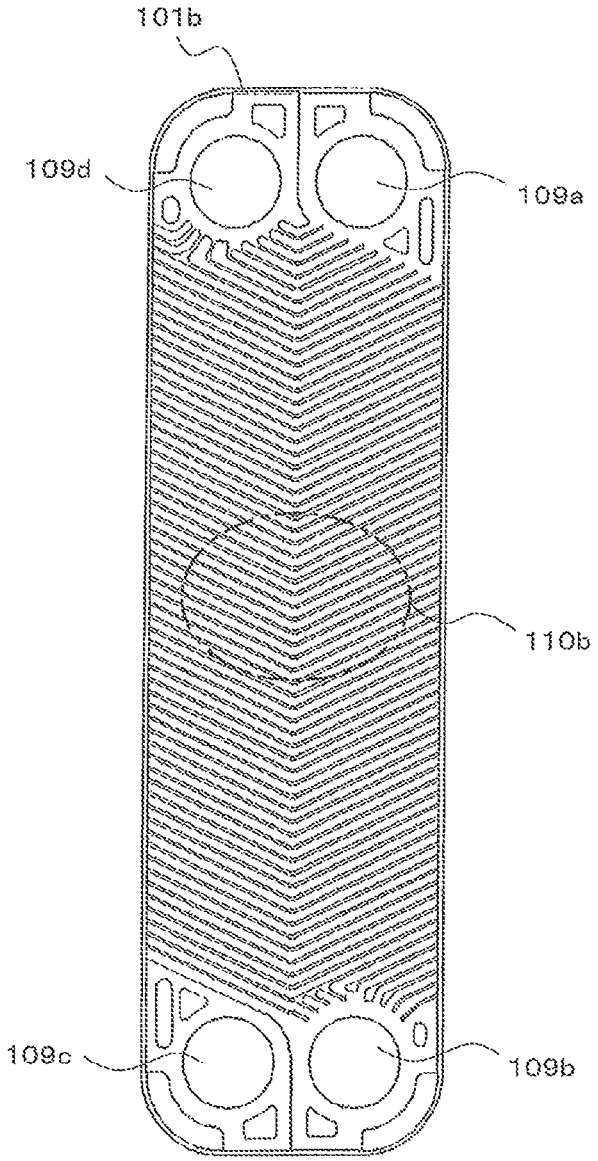
FIG. 7*b* is a full view of a heat transfer plate (101*b*) illustrated in FIG. 6.

FIG. 7*a* is a full view of the heat transfer plate 101*a*. FIG. 7*b* is a full view of the heat transfer plate 101*b*. The heat transfer plate 101*a* illustrated in FIG. 7*a* and the heat transfer plate 101*b* illustrated in FIG. 7*b* have the same size and the same thickness. Each of the heat transfer plates 101*a* and 101*b* has channel holes 109*a* to 109*d* at four corners thereof. Corrugated shapes 110*a* and 110*b* for stirring fluid are disposed between the channel holes 109*a* and 109*d* and the channel holes 109*b* and 109*c* in the longitudinal direction of the heat transfer plate 101*a* (101*b*). The corrugated shape 110*a* of the heat transfer plate 101*a* is inverted 180 degrees (upside down) from the corrugated shape 110*b* of the heat transfer plate 101*b*. That is, the corrugated shape 110*b* is at a position by rotating the corrugated shape 110*a* 180 degrees in the direction indicated by an arrow with respect to a point P. The channel holes 109*a* and 109*b* of the heat transfer plate 101*a* and peripheral portions thereof in FIG. 7*a* are located at lower levels than the channel holes 109*c* and 109*d* and peripheral portions thereof in the vertical direction (i.e., at deeper positions in the vertical direction on the drawing sheet). Similarly, in the heat transfer plate 101*b* illustrated in FIG. 7*b*, the channel holes 109*c* and 109*d* and peripheral portions thereof are located at lower levels than the channel holes 109*a* and 109*b* and peripheral portions thereof in the vertical direction (i.e., at deeper positions in the vertical direction on the drawing sheet).

(Channel Formation by Heat Transfer Plates 101*a* and 101*b*)

(Heat Transfer Plate Group 102*a*)

The heat transfer plates 101*a* and 101*b* are stacked so that the corrugated shape 110*a* and the corrugated shape 110*b* are in point-contact with each other. The point-contact portions are brazed to serve as "pillars" forming channels. For example, a channel for the second fluid (e.g., pure water, tap water, or water containing an antifreeze) is formed by stacking the heat transfer plate 101*a* and the heat transfer plate 101*b* in this order. A channel for the first fluid (e.g., a refrigerant, typified by R410A, for use in an air-conditioning apparatus) is formed by stacking the heat transfer plate 101*b* and the heat transfer plate 101*a* in this order. Layers of "second fluid-first fluid" are formed by stacking the heat transfer plate 101*a*, the heat transfer plate 101*b*, and the heat transfer plate 101*a* in this order. Subsequently, the number of stacked heat transfer plates is increased so that channels for "second fluid-first fluid-second fluid-first fluid, . . . " are alternately formed (see FIGS. 4 and 6). The stacked heat transfer plates 101*a* and 101*b* described above constitute the heat transfer plate group 102*a* as illustrated in FIGS. 5 and 6. At this time, the number of heat transfer plates 101*a* and 101*b* is an even number, and the stack starts at the heat transfer plate 101*a* and ends at the heat transfer plate 101*b*. Thus, the second fluid flows in the outermost member of the heat transfer plate group 102*a*.

(Heat Transfer Plate Group 102*b*)

In a manner similar to the heat transfer plate group 102*a*, the heat transfer plates 101*a* and 101*b* are stacked to constitute the heat transfer plate group 102*b*. A channel for the first fluid is formed by stacking the heat transfer plate 101*b* and the heat transfer plate 101*a* in this order. A channel for the third fluid is formed by stacking the heat transfer plate 101*a* and the heat transfer plate 101*b* in this order.

Layers of "first fluid-third fluid-first fluid" are formed by stacking the heat transfer plate 101*a*, the heat transfer plate 101*b*, and the heat transfer plate 101*a*. Subsequently, channels for "first fluid-third fluid-first fluid . . . " are alternately formed by increasing the number of stacked heat transfer plates (see FIGS. 4 and 6). The stacked heat transfer plates 101*a* and 101*b* described above constitute the heat transfer plate group 102*b* as illustrated in FIGS. 5 and 6. At this time, the number of heat transfer plates 101*a* and 101*b* is an even number, and the stack starts at the heat transfer plate 101*b* and ends at the heat transfer plate 101*a*. Thus, the first fluid flows in the outermost member (i.e., the channel closest to the heat transfer plate group 102*a*) of the heat transfer plate group 102*b*.

(Side Plates 105*a* and 105*b*)

Figure 8A:
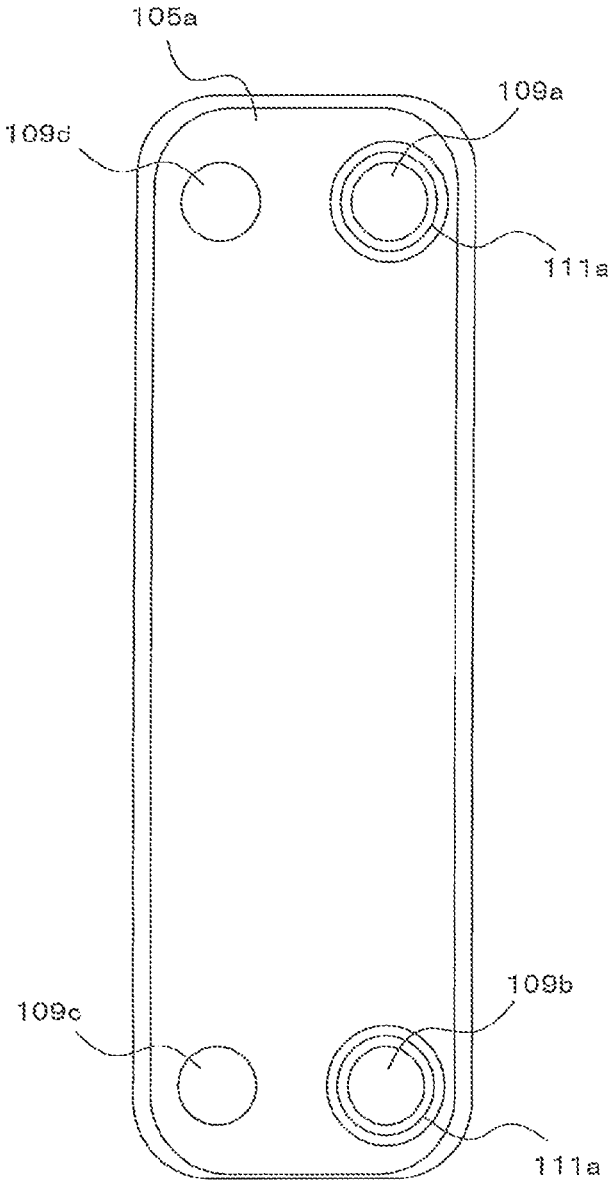
FIG. 8*a* is a full view of a side plate (105*a*) illustrated in FIG. 6.
Figure 8B:
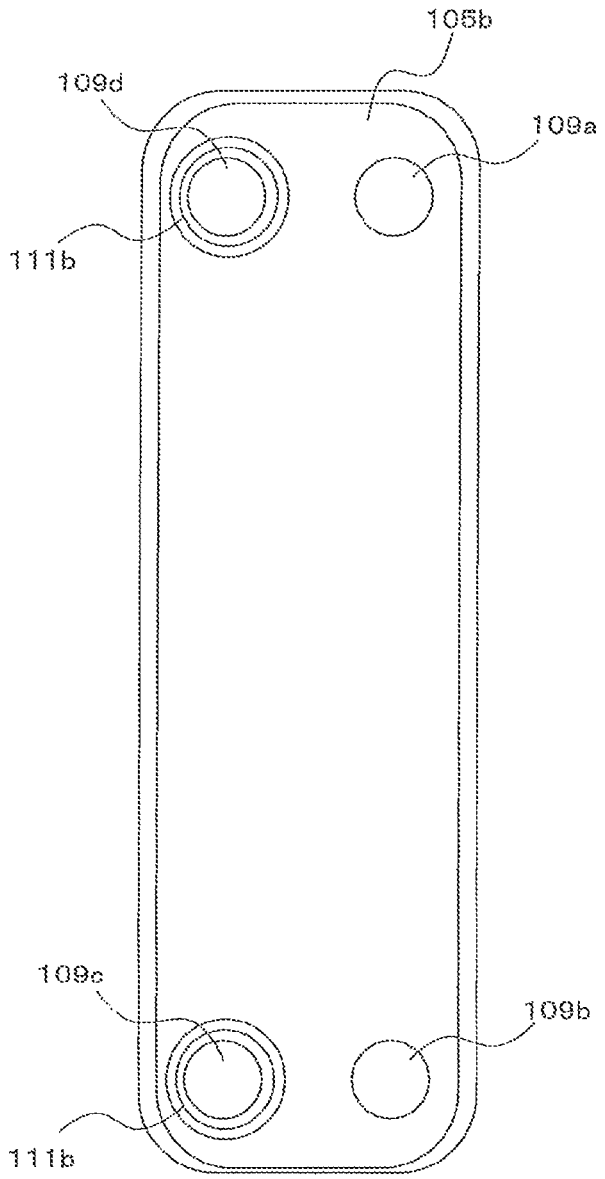
FIG. 8*b* is a full view of a side plate (105*b*) illustrated in FIG. 6.

FIG. 8*a* is a full view of the side plate 105*a* illustrated in FIG. 6. FIG. 8*b* is a full view of the side plate 105*b* illustrated in FIG. 6. The side plate 105*a* and the side plate 105*b* are flat plates that have sizes and thicknesses similar to those of the heat transfer plates 101*a* and 101*b*, each have channel holes 109*a* to 109*d* at the four corners thereof, and do not have corrugated shape 110*a*, 110*a*. As illustrated in FIG. 5, the side plate 105*a* is disposed on top of the heat transfer plate group 102*a*, and the side plate 105*b* is disposed at the bottom of the heat transfer plate group 102*b*, thereby constituting the fundamental part 108. As illustrated in FIGS. 8*a* and 8*b*, each of the channel holes 109*a* and 109*b* of the side plate 105*a* has a narrowing portion 111*a*, and each of the channel holes 109*c* and 109*d* of the side plate 105*b* has a narrowing portion 111*b*.

(Narrowing Portions 111*a* to 111*d*)

As illustrated in FIGS. 5, 8*a*, and 8*b*, the side plate 105*a* has recessed narrowing portions 111*a* formed by a narrowing process around the channel holes 109*a* and 109*b*, and the side plate 105*b* has projected narrowing portions 111*b* formed by a narrowing process around the channel holes 109*c* and 109*d*. The narrowing portions 111*a* and 111*b* are brazed to portions around the channel holes 109*a* and 109*b* of the heat transfer plates 101*a* and 101*b* so that pillars are formed around the channel holes of the heat transfer plate 101*a* and the side plates 105*a* and 105*b*, thereby increasing the strength thereof.

As illustrated in FIG. 5, the narrowing portions 111*a* of the side plate 105*a* form a heat nontransfer space 112*a* formed by the side plate 105*a* and the heat transfer plate 101*a* and prevent the first fluid from flowing therein. The heat nontransfer space 112*a* is a space formed by a plane and the corrugated shape (110*b*), and has poor heat conduction. Thus, it is possible to prevent the first fluid from flowing into the heat nontransfer space 112*a* so that excessive heat transfer and a decrease in flow rate of refrigerant can be prevented. Similarly, the narrowing portions 111*b* of the side plate 105*b* form a heat nontransfer space 112*b* formed by the side plate 105*b* and the heat transfer plate 101*a* and prevent the third fluid flow flowing therein.

Reinforcing Plate (Pressure-resistant Plate) 104*a* and 104*b*)

Figure 9A:
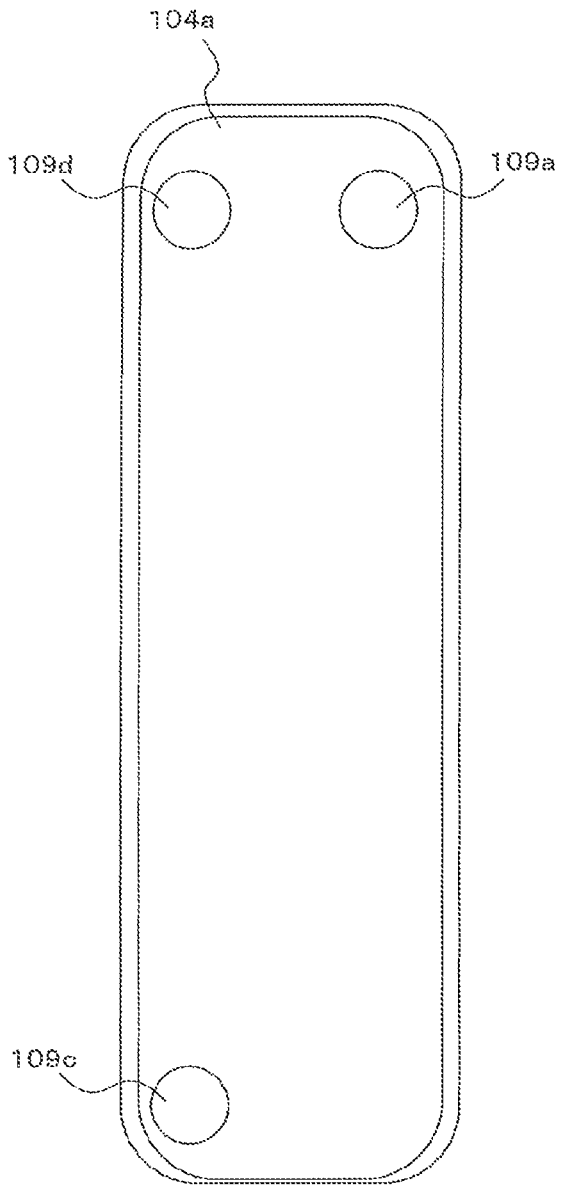
FIG. 9*a* is a full view of a reinforcing plate (104*a*) illustrated in FIG. 6.
Figure 9B:
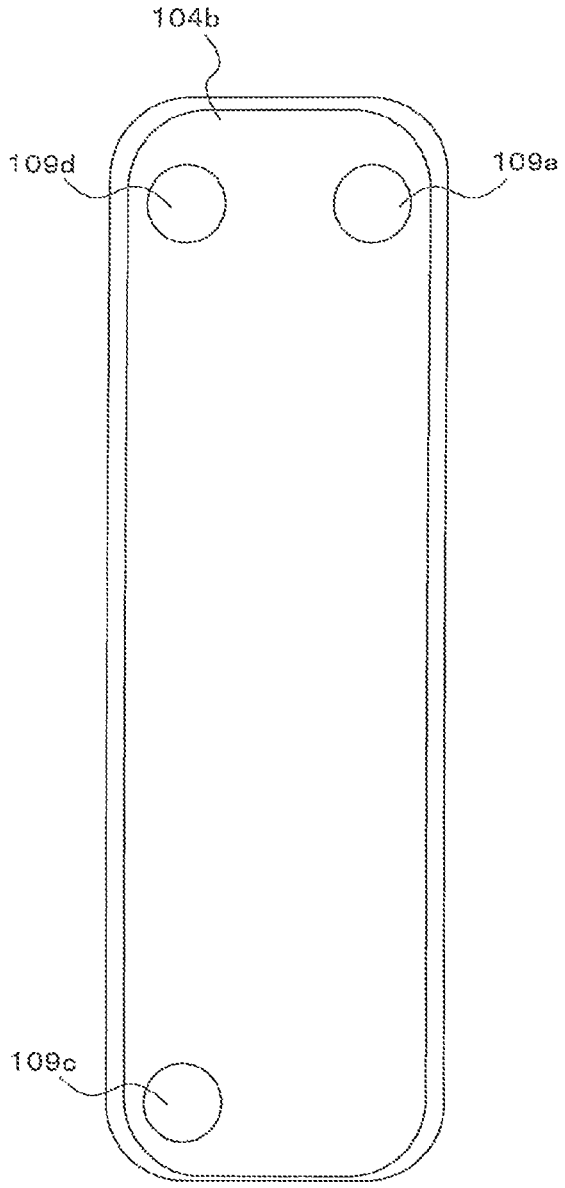
FIG. 9*b* is a full view of a reinforcing plate (104*b*) illustrated in FIG. 6.

FIG. 9*a* is a full view of the reinforcing plate 104*a* illustrated in FIG. 6. FIG. 9*b* is a full view of the reinforcing plate 104*b* illustrated in FIG. 6. As illustrated in FIG. 5, the reinforcing plate 104*a* is attached to the top of the fundamental part 108, and the reinforcing plate 104*b* is attached to the bottom of the fundamental part 108. Each of the reinforcing plates 104*a* and 104*b* has a thickness about five times as large as those of the heat transfer plates 101*a* and 101*b* and the side plate 105, for example. In the plate heat exchanger 1, each of the reinforcing plates 104*a* and 104*b* has three channel holes 109*a*, 109*c*, and 109*d* as illustrated in FIG. 9.

In the reinforcing plate 104*a*, the nozzles 103*a*, 103*d*, and 103*e* are brazed to the channel holes 109*a*, 109*c*, and 109*d*, respectively, at the side opposite to the heat transfer plate group 102*a*. In the reinforcing plate 104*b*, the nozzles 103*b*, 130*c*, 103*f*, and 103*g* are brazed to the channel holes 109*a*, 109*c*, and 109*d*, respectively, at the side opposite to the heat transfer plate group 102*b*. The reinforcing plates 104*a* and 104*b* enable the plate heat exchanger 1 to withstand fatigue due to a variation of a pressure caused by a fluid flowing in the fundamental part 108 and a force occurring due to a difference between the pressure of the plate heat exchanger 1 and an atmospheric pressure.

(Isolation Plates 106*a* and 106*b*)

Figure 10A:
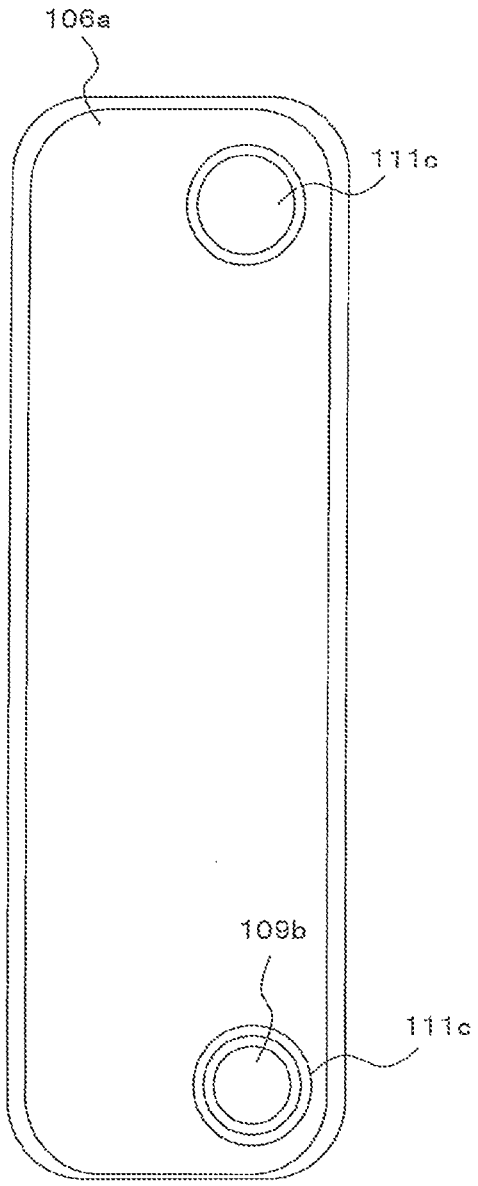
FIG. 10*a* is a full view of an isolation plate (106*a*) illustrated in FIG. 6.
Figure 10B:
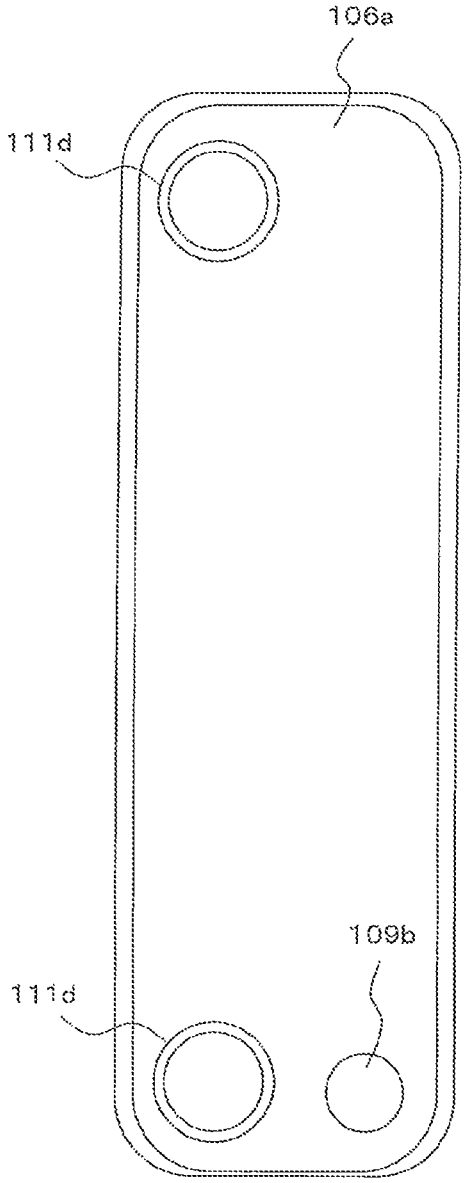
FIG. 10*b* is a full view of an isolation plate (106*b*) illustrated in FIG. 6.

FIG. 10*a* is a full view of the isolation plate 106*a* illustrated in FIG. 6. FIG. 10*b* is a full view of the isolation plate 106*b*. As illustrated in FIG. 5, the isolation plate 106*a* is disposed at the bottom of the heat transfer plate group 102*a*, and the isolation plate 106*b* is disposed on top of the heat transfer plate group 102*b*. The isolation plate 106*a* is a flat plate that has a size and a thickness similar to those of the heat transfer plate 101*a* (101*b*), has a channel hole 109*b*, and does not have the corrugated shape 110*a*. The isolation plate 106*a* has a narrowing portion 111*c* at the side facing the heat transfer plate group 102*a*, and as illustrated in FIG. 5, is brazed to peripheral portions of the channel holes 109*a* and 109*b* of the heat transfer plate 101*b* lastly stacked in the heat transfer plate group 102*a* to prevent the first fluid from flowing into a heat nontransfer space 112*c*. Similarly, the isolation plate 106*b* is also a flat plate that has a size and a thickness similar to those of the heat transfer plate 101*b* (101*a*), has a channel hole 109*b*, and does not have the corrugated shape 110*b*. The isolation plate 106*b* has a narrowing portion 111*d* at the side facing the heat transfer plate group 102*b*, and as illustrated in FIG. 5, is brazed to peripheral portions of the channel holes 109*c* and 109*d* of the heat transfer plate 101*b* to prevent the third fluid from flowing into the heat nontransfer space 112*d*.

(Intermediate Reinforcing Plate 107)

Figure 11:
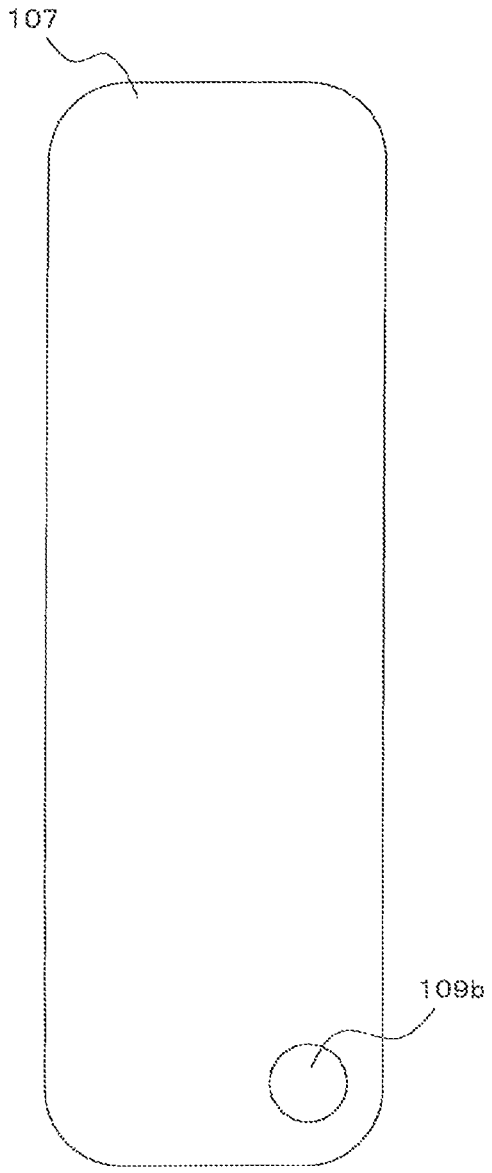
FIG. 11 is a full view of an intermediate reinforcing plate (107*b*) illustrated in FIG. 6.

FIG. 11 is a full view of the intermediate reinforcing plate 107 illustrated in FIG. 6. As illustrated in FIG. 11, the intermediate reinforcing plate 107 has the same shape and the same thickness as those of the reinforcing plates 104*a* and 104*b*, and has a channel hole 109*b*. The intermediate reinforcing plate 107 is sandwiched between the isolation plate 106*a* and the isolation plate 106*b*, and can withstand a force occurring due to a difference between the pressure of the second fluid and the pressure of the third fluid.

The heat transfer plate group 102*a* and the heat transfer plate group 102*b* are brazed with the isolation plate 106*a*, the intermediate reinforcing plate 107, and the isolation plate 106*b* sandwiched therebetween so that the plate heat exchanger 1 can serve as both the first heat exchanger 4 and the second heat exchanger 5. Since the outermost member of the heat transfer plate group 102*a* is the second fluid, and the outermost member of the heat transfer plate group 102*b* is the first fluid, a channel configuration of a fluid flow schematically illustrated in FIG. 4 is formed so that the second fluid does not contact the third fluid at a low temperature. Thus, a decrease in the outlet temperature of the second fluid can be suppressed so that thermal efficiency of the plate heat exchanger 1 can be enhanced.

REFERENCE SIGNS LIST

1 plate heat exchanger, 2 heat pump outdoor unit, 3 compressor, 4 first heat exchanger, 5 second heat exchanger, 6*a*, 6*b* electronic expansion valve, 7 third heat exchanger, 8, 8*b* refrigerant, 9 water circuit, 10 water, 11 heating appliance, 12 water heat exchange tank, 13 clean water, 101*a* heat transfer plate, 101*b* heat transfer plate, 102*a* heat transfer plate group, 102*b* heat transfer plate group, 103*a* to 103*g* nozzle, 104*a*, 104*b* reinforcing plate, 105*a*, 105*b* side plate, 106*a*, 106*b* isolation plate, 107 intermediate reinforcing plate, 108 fundamental part, 109*a* to 109*c* channel hole, 110*a*, 110*b* corrugated shape, 111*a* to 111*d* narrowing portion, 112*a* to 112*d* heat nontransfer space.

The invention claimed is:

1. A plate heat exchanger comprising:

a first heat transfer plate group configured to exchange heat between a first fluid of high-temperature, high-pressure gas refrigerant and a second fluid of a heating target fluid; and a second heat transfer plate group configured to exchange heat between a first fluid of low-temperature, high-pressure liquid refrigerant and a third fluid of low-temperature, low-pressure two-phase liquid refrigerant, wherein the first heat transfer plate group forms a first plurality of channels constituted by a stack of plates, wherein the first heat transfer plate group has a configuration such that a flow of the first fluid of high-temperature, high-pressure gas refrigerant and a flow of the second fluid are alternately aligned in the first plurality of channels, and wherein the configuration of the first heat transfer plate group causes the second fluid to flow in an outermost channel of the first plurality of channels, and the second heat transfer plate group forms a second plurality of channels constituted by a stack of plates, wherein the second heat transfer plate group has a configuration such that a flow of the first fluid of low-temperature, high-pressure liquid refrigerant and a flow of the third fluid are alternately aligned in the second plurality of channels, and wherein the configuration of the second heat transfer plate group causes the first fluid of low-temperature, high-pressure liquid refrigerant to flow in a channel of the second plurality of channels that is adjacent to the first heat transfer plate group.

2. The plate heat exchanger of claim 1, further comprising:

a pair of isolation plates disposed between the first heat transfer plate group and the second heat transfer plate group; and an intermediate reinforcing plate that is disposed between the pair of isolation plates and reinforces the pair of isolation plates.

3. A heat pump outdoor unit comprising:

a compressor;

a first heat exchanger serving as a condenser;

a first expansion valve;

a second heat exchanger serving as a subcooler;

a second expansion valve; and a third heat exchanger serving as an evaporator, wherein the first heat exchanger exchanges heat between a first fluid of high-temperature, high-pressure gas refrigerant and a second fluid of a heating target fluid, the second heat exchanger exchanges heat between a first fluid of low-temperature, high-pressure liquid refrigerant condensed in the first heat exchanger and a third fluid of low-temperature, low-pressure two-phase fluid obtained by causing a part of the first fluid of low-temperature, high-pressure liquid refrigerant to flow through the first expansion valve, and the first heat exchanger and the second heat exchanger are constituted by the plate heat exchanger of claim 1.

4. The plate heat exchanger of claim 2, wherein the pair of isolation plates are spaced apart from each other in a direction that is perpendicular to a plane of the isolation plates.

5. The plate heat exchanger of claim 1, wherein the first heat transfer plate group includes an inlet for the first fluid, an inlet for the second fluid, and an outlet for the second fluid, and the second plate group includes an inlet for the third fluid, an outlet for the third fluid, and two outlets for the first fluid, wherein the inlets and outlets are exposed to an exterior of the plate heat exchanger.

* * * * *